United States Patent [19]

Hiszpanski

[11] 4,099,290

[45] Jul. 11, 1978

[54] SWEEPER WITH RECIRCULATION HOOD HAVING AN UNOBSTRUCTED PICKUP WINDOW

[75] Inventor: Jan A. Hiszpanski, Upland, Calif.

[73] Assignee: FMC Corporation, San Jose, Calif.

[21] Appl. No.: 796,584

[22] Filed: May 13, 1977

[51] Int. Cl.[2] ..... A47L 5/14

[52] U.S. Cl. ..... 15/340; 15/346; 15/420

[58] Field of Search ..... 15/340, 345, 346, 420

[56] References Cited

U.S. PATENT DOCUMENTS

| | | | |
|---|---|---|---|
| 3,007,191 | 11/1961 | Braun | 15/346 X |
| 3,938,217 | 2/1976 | Hommes | 15/346 |
| 4,044,422 | 8/1977 | Larsen | 15/340 |

FOREIGN PATENT DOCUMENTS

| | | | |
|---|---|---|---|
| 1,155,156 | 10/1963 | Fed. Rep. of Germany | 15/346 |

*Primary Examiner*—Christopher K. Moore
*Attorney, Agent, or Firm*—C. E. Tripp; J. F. Verhoeven

[57] ABSTRACT

A mobile street sweeper of the air recirculation pickup hood type has a hopper and a dust filter chamber. A main blower exhausts air from the hopper and introduces it into one end of the hood and air is returned to the hopper from the other end of the hood. An auxiliary blower withdraws air from the filter chamber and exhausts it to atmosphere. The hood is provided with an unobstructed front window and angled deflectors which windrow large objects into the window. The upstream end of the window is disposed at a zone wherein the static pressure of the air stream circulating along the hood is at atmospheric pressure and the downstream end of the window is disposed at a zone wherein the static pressure is only slightly less than atmospheric pressure.

15 Claims, 11 Drawing Figures

22
154a
178
154
13
185b
176
179
174
15a
156
156a
158a
158b
156b
184
14
L
158
150
185a
162a
163
162
S'
166
S'
11
15a
W
194
8
8
172
173
170
14a
190
d
202
152
204
152a
13
P
206
20
200 d
P
22
11
154
156
13
156a
th
150
176
174
178
156b
158b
15a
W
194
162b
163
162
162a
184
186
14 th
154
154a
13
178
22
156a
S
156
P
11
150
S
161a
162
160
162b
158b
156b
158
W
S
161
200
fmb
202
180
182
152
152a
13
20

SWEEPER WITH RECIRCULATION HOOD HAVING AN UNOBSTRUCTED PICKUP WINDOW

FIELD OF THE INVENTION

This invention relates to sweepers and more particularly to sweepers for streets, parking lots, etc. of the type having an air recirculation pickup hood formed with a door or window for receiving large articles.

DESCRIPTION OF PRIOR ART

Sweepers having pickup hoods may be divided into two general categories relative to their pickup hood operation. These categories are vacuum hood sweepers and air recirculation hood sweepers.

VACUUM HEAD SWEEPERS

The patent to Sims, U.S. Pat. No. 1,560,612, Nov. 10, 1925, shows a vacuum sweeper which does not embody a hood but wherein angled brushes windrow particles for pickup by a suction nozzle 29 that leads to the hopper or tank of the sweeper. A blower 32 withdraws air from the tank to create a suction at the nozzle.

Boyce et al. U.S. Pat. No. 2,529,993, Nov. 14, 1950 discloses a suction street sweeper having a hood or collector box 17 with depending end walls and front and rear flaps 63 that terminate in proximity to the swept surface. As seen in FIG. 3, the front flap 63 stops short of one end wall to provide a trash entrance 65 that is always open. The suction line **19*a* is connected to the inlet of a blower or fan 21 (FIG. 1) which delivers air and trash to a hopper 13**.

Campbell U.S. Pat. No. 3,384,920, May 28, 1968, shows a vehicle mounted cleaning device, including a vacuum cleaner head or hood 16 having one closed end, front and rear flexible flaps 39,40 and one open end. A suction pipe 49 at the closed end connects to a duct 12 forming the inlet to a blower 10 which exhausts air into the hopper, the air flowing through a filter steam 15 and out into the atmosphere through an outlet 14.

Hank et al. U.S. Pat. No. 3,605,170, Sept. 20, 1971 shows a mobile suction cleaning device including a pickup chamber or hood E formed with two suction nozzles 60,62 connected to an evacuated hopper D. A fan or blower C withdraws air from the hopper and exhausts it to the atmosphere. Particles are windrowed into the inlet nozzle 62 by air jet pipes 66 connected to an auxiliary compressor 86.

The French Pat. No. 628,869 to Anger dated 1927 shows a suction nozzle 14 connected directly to the inlet of a blower and particles are windrowed to the nozzle by angled brushes 19.

Braun U.S. Pat. No. 3,007,197, Nov. 7, 1961 discloses a sweeping machine that provides a combination of air recirculation and vacuum pickup systems. A hood mounts a rotary broom 6 and the hood receives air directly from the blower by means of ducts 7' and the air of the blower is returned to a hopper by means of ducts 8'. The air circulation within the hood is transverse and not longitudinal. In addition to the broom and hood assembly, Brown discloses a suction pipe 9,10 which opens to receive coarse particles windrowed to the nozzle by members **23,23*a*. A suction pipe 9** is connected to the hopper and the hopper is evacuated by the blower.

Vacuum or suction cleaning units of this type just described all have one undesirable characteristic. The pickup nozzles or hoods are connected to a zone of highest vacuum (minimum pressure) either by means of a connection to a blower-evacuated hopper or directly to the inlet of a blower. The particles to be picked up are accelerated by the aerodynamic force of the air stream. In vacuum devices of this type, not only must the articles to be picked up be accelerated to their pickup velocity, but the air stream itself, which imparts the necessary energy to thus accelerate the articles, must also be accelerated from a zero velocity to the necessary pickup velocity. Thus, the blower system for vacuum pickup devices must not only be supplied with sufficient energy to pick up the articles but also must be supplied with sufficient energy to accelerate an air stream from zero velocity to an article pickup velocity.

RECIRCULATION HOOD PICKUP

Another category of sweeper hoods can be referred to as the air recirculation type. In these hoods there are two separate air connections. One connection is connected to the outlet of a fan or blower which directs a stream of air under pressure into the hood. The other connection returns the stream of air to the blower, usually by means of an intervening dust collecting hopper and filter screen. Air recirculation hoods have the advantage that once set into operation they confine a continuous flowing or circulating streams of air which has kinetic energy sufficient to pick up and entrain materials such as dust, debris and other articles as the vehicle advances the hood over the materials. Thus, hoods of this type require less total energy than vacuum pickup hoods because the materials are introduced into a continuously circulating stream of air which has sufficient kinetic energy to entrain them and carry them into the hopper. It is not necessary to accelerate a mass of air in order to pick up and entrain the materials and hence air recirculation hoods require less energy for driving the blowers than do vacuum hoods having the same capacity. The most efficient air recirculation hoods incorporate depending flexible flaps which engage the surface to be swept and thus confine the air flow to a path within the hood.

Air circulation hoods can be generally classified as being of two types. The first type of hood is represented by those shown in the U.S. Pats. to Williams, No. 3,755,851, Sept. 4, 1973; Young, No. 3,512,206, May 19, 1970 and Block, No. 3,872,540, Mar. 25, 1975. These hoods which involve both flow of air transversely of the hood as well as longitudinally along the hood and embody inherently inefficiencies in that energy is lost due to the requirement of changing the direction of air flow between the point of air entry and air exhaust. These changes in air direction within the hood can also cause turbulence and provide stagnation zones wherein materials may drop out of the air stream. Also, the internal construction of such hoods is relatively complex and provide obstructions to air flow which decreases their efficiency and increases their cost. This can be readily understood by examination of FIG. 12 of the Young patent, FIG. 10 of the Williams patent and FIG. 4 of the Block patent, for example.

An early attempt to provide a unidirectional air flow and hence a more efficient recirculating hood appears in the patent to Furnas, U.S. Pat. No. 514,678, issued Feb. 13, 1894. This patent discloses an inner hood 14, having flexible front and rear flaps engaging the swept surface. Air from the blower in conduit 8 enters an outer hood 15 and flows into an open end of the inner hood. Air is withdrawn directly from the opposite end of the inner hood by conduit 5 and is directed into an airtight collecting box, which is exhausted by the blower. However, the Furnas hood would be unacceptable under present requirements because the air from the blower in conduit 8 first enters the outer hood 15 and this hood surrounds the inner hood 14 and is sealed by flaps with the swept surface. This construction provides an outer compartment wherein air under pressure is present and when debris or articles lift the flaps for the outer hood anywhere along its length, dust puffs out, which is an undesirable mode of operation.

Another patent showing an air circulation hood is Hanna U.S. Pat. No. 3,662,427, issued May 16, 1972. This patent shows a zone of air circulation in pressure chmber 33 surrounded by front and rear vacuum chambers 32 and 31. There is an undesirable energy loss in the recirculating airstream because as seen in FIG. 3, the flap 38 partially defining the recirculating air chamber stops short of the surface, so that the air flows out of the recirculating air chamber into the rear vacuum chamber 31 thereby detracting from the kinetic energy of the recirculating airstream available for picking up articles.

A more efficient air recirculation hood is shown in the patent to Larsen, U.S. Pat. No. 4,006,511, issued Feb. 8, 1977 and assigned to the FMC Corporation. This patent discloses a substantially unobstructed, transversely disposed air recirculation hood with air entering one end of the hood from a main blower by a conduit 20, which exhausts air from a hopper H. The other end of the hood is connected by a conduit 22 to the hopper and thus creates a recirculating stream of air through the hood for entraining and picking up dust, debris and articles as the hood advances over them. This patent also discloses an auxiliary blower AB that withdraws air from the hopper through a filter system and exhausts it to the atmosphere. The auxiliary blower draws an amount of air from the hopper substantially equal to the amount of air that leaks into the hood beneath the flaps or when a passage is provided between the hood and the swept surface by articles which lift the flaps.

Reference is also made to the copending application of Larsen, Ser. No. 647,521, filed Jan. 8, 1976, now U.S. Pat. No. 4,044,422, issued Aug. 30, 1977, and assigned to the FMC Corporation. This application discloses a recirculation hood like that disclosed in the aforesaid Larsen U.S. Pat. No. 4,006,511. The application is directed to a system for admitting large articles to the hood without causing puffing of dust from the hood and without requiring the acceleration of a relatively large stream of air at the zone where the articles are admitted. This object is accomplished by providing a tunnel 15 adjacent the suction end of the hood, which tunnel is provided with alternately opening and closing mechanically operated airlock doors 15*a*, 15*b*. As seen in the operation of FIGS. 4 - 7 of this patent, an article such as a can K is admitted to the interior of the hood P but the airlock doors minimize the amount of air that is drawn into the hood along with the article.

SUMMARY OF THE INVENTION

The sweeper of the present invention and particularly the hood construction can be considered to represent an improvement over the hood disclosed in the aforesaid copending Larsen application Ser. No. 647,521 assigned to the FMC Corporation. The hood of the present invention provides a front opening window for admitting large articles, does not puff out air through the window, draws very little air into the window, and does not require an airlock door system with its attendant mechanical operators and controls. Briefly, the sweeper of the present invention comprises a vehicle carrying a hopper, an elongate, transversely disposed debris pickup hood of the air recirculation type having flexible surface engaging flaps, blower means for withdrawing air from the hopper and introducing the air under pressure through an air delivery line to a zone adjacent one end of the hood, a drive for the blower means, an air return line adjacent the other end of the hood for returning the air to the hopper thereby causing a stream of air to flow along the hood, a bulky object admitting window formed in the front of the hood which is substantially shorter than the hood and which has upstream and downstream ends and means for windrowing objects into the window. The structure thus far described is also shown in the aforesaid Larsen application, Serial No. 647,521. The improvement of the present invention comprises means for causing the blower means to provide a first zone intermediate the length of the hood wherein the static pressure of the airstream substantially equals atmospheric pressure with the static pressure of the air stream downstream of the first zone becoming progressively more negative relative to atmospheric pressure. The upstream end of the window is disposed substantially at the first or atmospheric pressure zone of the hood and the downstream end of the window is disposed at a second zone along the hood wherein the static pressure of the airstream is slightly less than atmospheric pressure but is substantially greater than the negative static pressure of the airstream at the air return line. The window is unobstructed during normal operation of the sweeper for freely admitting bulky objects along with a small stream of air.

In the preferred sweeper embodying the invention, in addition to a main blower which exhausts air from the hopper and directs it to the hood, an auxiliary blower is provided for withdrawing air through filters as in the aforesaid Larsen U.S. Pat. No. 4,006,511 and these filters are periodically kept clean as disclosed in the Groh U.S. Pat. No. 4,007,026, Feb. 8, 1977, assigned to the FMC Corporation. In this system, once a predetermined blower size and speed and the associated ducting system has been selected, and sweeper will operate so that the static pressure at points along the recirculated air stream flowing along the hood remains substantially constant due to periodic cleaning of the filters at frequent intervals. Thus substantially steady state flow of the recirculating air stream in the hood is provided, which insures that the upstream end of the window will always be disposed substantially at the zero gauge static or atmospheric pressure zone of the hood. Also, because the deflectors windrow large articles into the window, the window need only be wide enough to admit the largest articles normally encountered, such as cans, bottles, etc. As a result, the downstream end of the window, which is exposed to a slight negative static pressure within the hood, is at a zone where that negative pressure is not substantially less than atmospheric pressure, and the average negative static pressure of the circulating air stream along the entire width of the window is ½ the slight negative pressure at the downstream end of the window. As a result, the quantity of air drawn into the window along with the bulky articles admitted through the window is relatively small and is easily compensated for in the preferred sweeper, by the action of the auxiliary blower and filter system previously mentioned. Thus, the sweeper of the present invention has all the advantages of vacuum hood sweepers in that the hood does not puff out dust as articles are admitted into the hood, has the advantages of the recirculating air type of hood in energy saving, does not puff out dust as bulky articles are admitted to the hood, and the amount of energy required to draw the small amount of air into the unobstructed window is substantially less than the energy required to accelerate incoming air from zero velocity to a velocity sufficient to pick up and entrain articles, as required by vacuum hoods. The amount of air that is drawn into the unobstructed window of the hood is relatively small and enters at a lower velocity than that of the main air stream. The energy required for picking up and entraining the articles is provided by the kinetic energy in the circulating air stream within the hood itself, and this air stream is flowing continuously at a high velocity. Furthermore, the need for a mechanically operated airlock system to reduce the amount of air drawn into the hood along with bulky objects is obviated under the present invention.

The inner end of the angled article deflector or windrower at the downstream end of the window merges with the hood by means of a short angle plate which diverges from the front wall of the hood in an upstream direction. The angle plate re-directs air back into the hood which might otherwise be diverted out of the hood by the aforesaid deflector.

In one embodiment of the invention, a damper or air restriction device can be provided in one of said lines, preferably in the air line to the hood, for adjusting the air flow so that the static pressure of the air circulation along the hood will be at atmospheric pressure at the upstream end of the window.

DETAILED DESCRIPTION

General Description of a Sweeper Embodying the Invention

In a preferred sweeper embodying the invention an air recirculation hood P embodying the present invention replaces the hood P of the aforesaid Larsen U.S. Pat. No. 4,006,511, and although the basic elements of the sweeper therein disclosed will be described herein for completeness, the disclosure of the Larsen patent and a description of the prior art cited therein are incorporated herein by reference. It is to be understood that under the broader aspects of the invention, a hood having the mode of operation of the hood of the present invention can be mounted on sweepers other than the two blower sweeper disclosed in the aforesaid Larsen patent.

Figure 1:
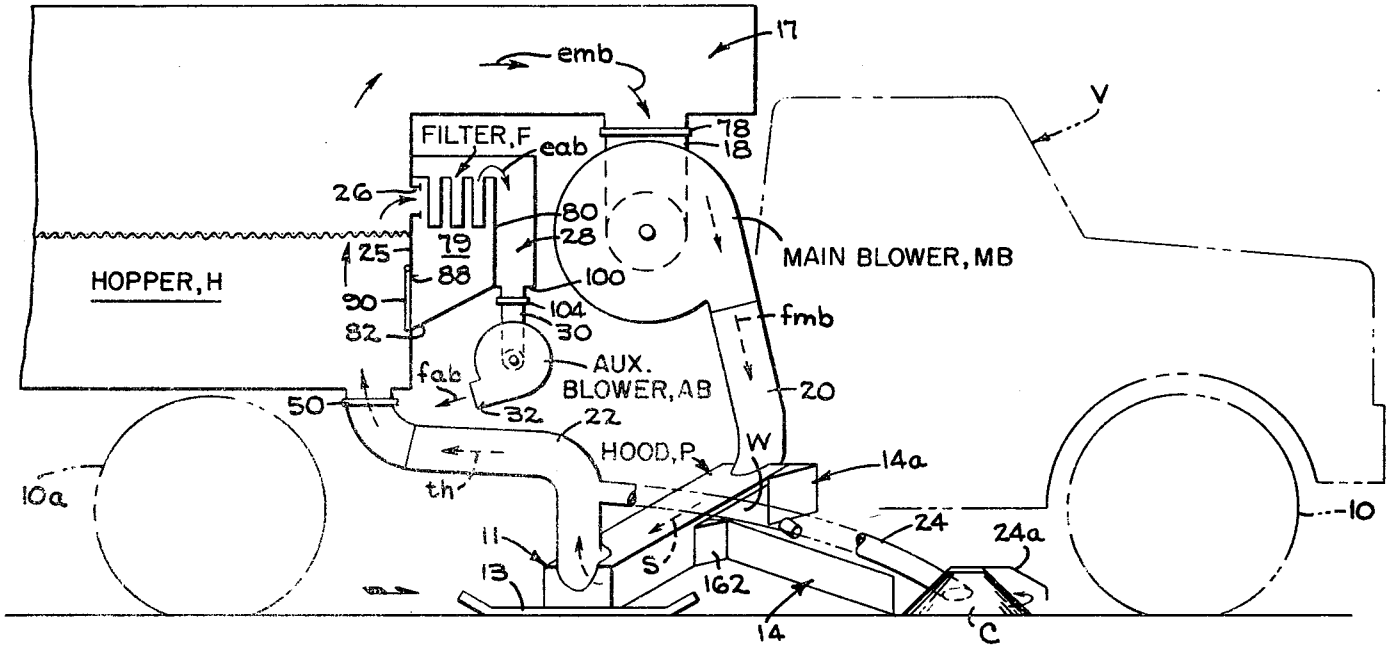
FIG. 1 is a schematic diagram of a sweeper having a two blower air recirculation system and a pick up hood embodying the present invention.
Figure 2:
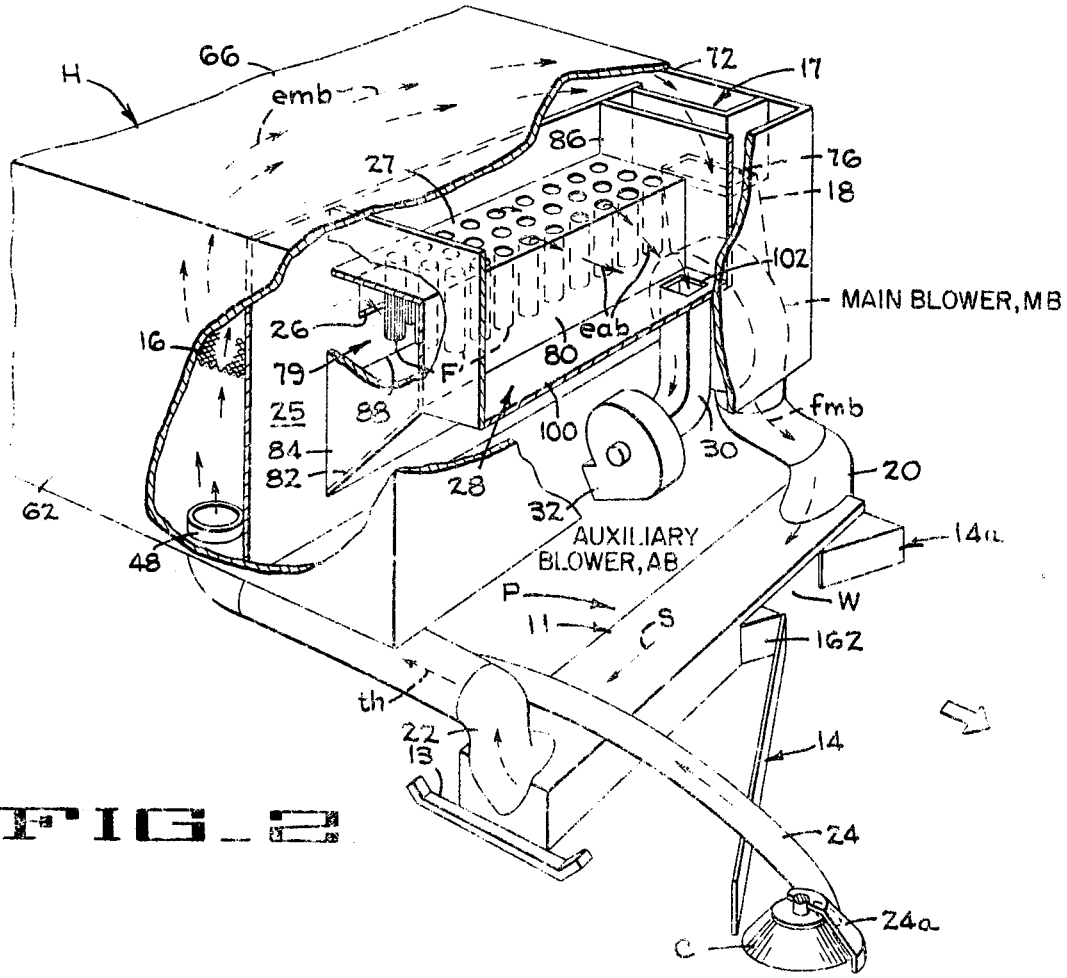
FIG. 2 is a fragmentary schematic perspective view of the air circulation system in the preferred embodiment.

FIG. 1 is a highly schematic diagram indicating the flow pattern of the sweeper air system and FIG. 2 is a schematic perspective which also indicates the flow pattern but the filter system is shown in more detail.

Referring principally to FIGS. 1 and 2, the sweeping system is mounted on a mobile vehicle V, which may be a converted truck chassis, the chassis including the front and rear wheels 10,10*a*. The sweeping system includes a main debris pickup unit in the form of a pickup hood P which provides a transversely mounted duct-like housing. The construction and principle of operation of the hood P forms the subject matter of the present invention and will be described in detail following this general description of the sweeper. At this time it will suffice to explain that the hood P is mounted on the vehicle chassis by a conventional floating suspension and the hood has a transversely disposed air recirculation channel or duct 11 with surface engaging front and rear flaps. The ends of the hood are supported on skids 13. As seen in FIG. 2, associated with the hood P are angled deflectors 14 and 14*a* which windrow large articles, such as cans or the like, for admission to a window W of the hood.

Figure 3:
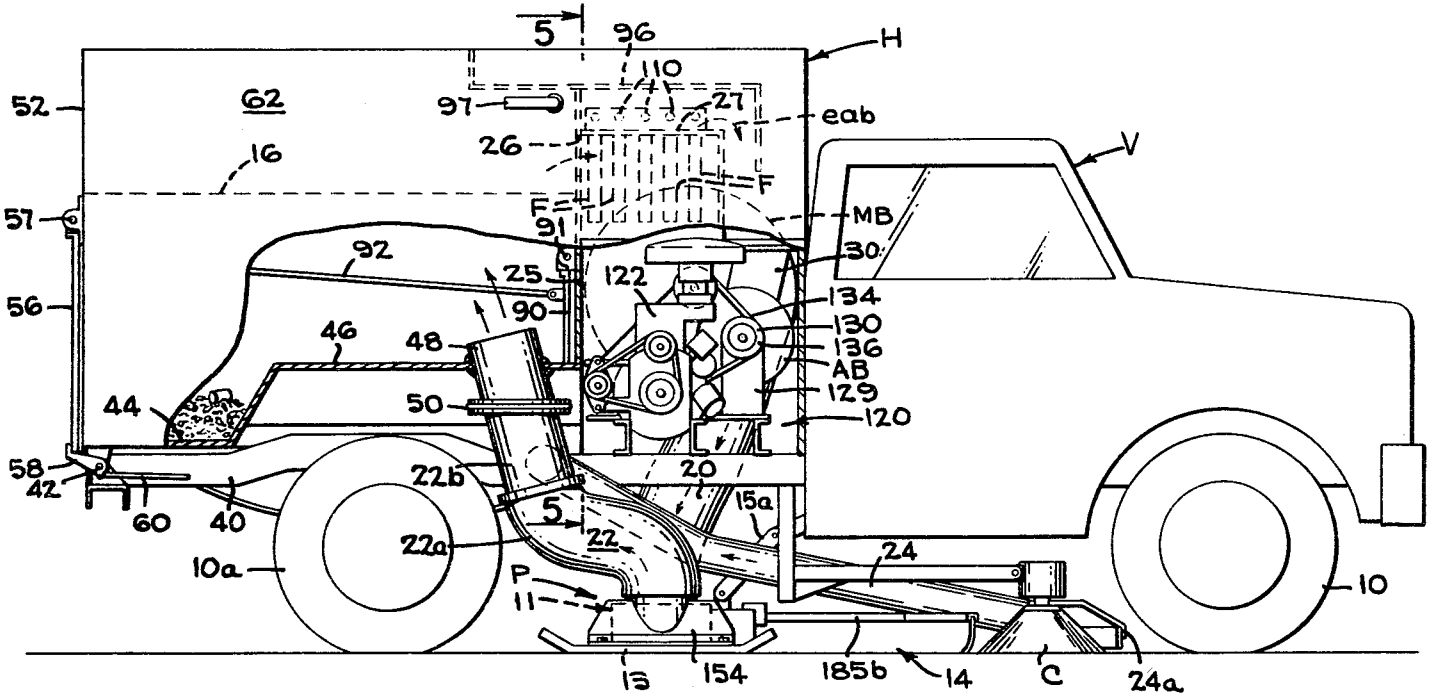
FIG. 3 is a side elevation of the sweeper of the present invention mounted on a truck chasis, with parts broken away.

As seen in FIG. 3, the hood P is dragged along the surface by links 15*a* that are pivotally connected to the hood and to the chassis, as described in Larsen U.S. Pat. No. 4,006,511. The details of the hood mounting are not critical to the present invention.

As described in detail in the Larsen patent, pivotally mounted at the rear of the vehicle chassis is a debris hopper H. This hopper is a box-like structure that can be elevated about a rear pivot to discharge accumulated debris through a rear door, as will be described presently. The hopper mounting and operating structures are not critical to the present invention.

The hopper H is fitted with a screen 16 to filter out coarse debris and one side of the hopper is formed with a forwardly projecting air return chamber 17 (FIGS. 2 and 4) which, during the sweeping operation, connects with the inlet conduit 18 of a main blower MB. The main blower withdraws air from the hopper and as indicated by the arrows "*emb*" and delivers it by an air delivery line 20 to one end of the duct 11 of the pickup hood P as indicated by the arrows "*fmb*". An air return line 22 is connected between the other end of the hood duct and the bottom of the hopper H, and the return line draws a debris laden air stream into the hopper as indicated by the arrows "*th*". In the embodiment shown, a suction line 24 is connected to the air return line 22, and the line 24 exhausts air and dust from within a shroud 24a that partially surrounds a curb brush C.

A front wall or partition 25 of the hopper H is formed with an elongate opening 26 which communicates with a compartment containing a filter assembly for filtering out fine particles and dust. The filter system comprises a series of tubular, porous filter elements F depending from a partition 27 into a dust collecting chamber of the filter. Preferably, the filter elements are pleated paper elements constructed in accordance with the principles of the patent to Groh, U.S. Pat. No. 4,007,026, issued Feb. 8, 1977 and assigned to the FMC Corporation, the disclosure of which is incorporated herein by reference. None of the references cited in the Groh patent application are pertinent to the air recirculation hood structure with an unobstructed window of the present invention. Air is drawn through the porous walls of the filter elements F, depositing dust on their exterior surfaces. Filtered air is drawn out through the open upper ends of the tubular filter elements, as indicated by the arrows "*eab*", into a filtered air chamber 28, which is connected to the inlet 30 of an auxiliary blower AB. The exhaust 32 of the auxiliary blower delivers filtered air to the atmosphere, as indicated by the arrows "*fab*".

In the embodiment of the present invention being described, the main blower MB is sized and rotated at such a speed as to deliver about 3,000 c.f.m. to the hood P via the line 20. This is about ¾ of the total system air flow.

The auxiliary blower AB makes up for air that is drawn into the hood through the window W and for air that leaks in under the hood flaps, as well as for air drawn in from the curb brush shroud through line 24. In the present embodiment, the auxiliary blower exhausts about 1,000 c.f.m., which is about ¼ of the total system air flow, from its inlet line 30. The inlet line 30 draws air from the filtered air chamber 28, through the filter assembly F (arrows "*eab*") and from the hopper H through the elongate opening 26 in the front wall 25 of the hopper. This system provides a recirculating air stream "*s*" that flows along the hood and represents about ¾ of the total air flow induced by the blowers. The air stream "*s*" has sufficient kinetic energy to pick up and entrain dust, trash, gravel, cans and other debris. This air and entrained debris are drawn through the air return line 22 leading from the pickup hood P to the hopper. In the hopper air velocity is reduced. Large articles drop out or are intercepted by the screen 16. The filter system F and the auxiliary blower AB continuously draw off about ¼ of the air entering the hopper and filters and exhausts the air drawn into the hood.

The use of independent blowers, blower AB for the fine filter units, and blower MB for circulating air through the hood, renders the system substantially self-balancing when operating under substantially the designed flow rate conditions over a wide range of actual sweeping conditions, particularly when the filters are periodically and frequently cleaned, as described in the aforesaid Groh patent. The main blower is connected directly between the hopper air return chamber 17 and the pickup hood P by the line 20 and hence the main blower need not be of excessive size because there are no fine filter elements in series with that blower.

Figure 5:
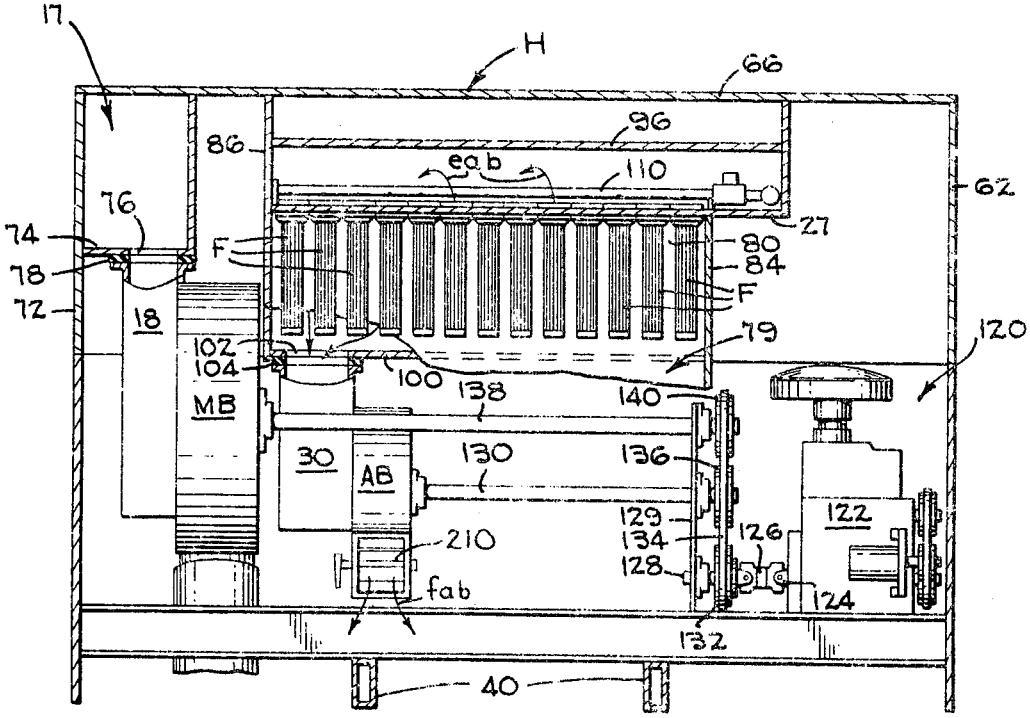
FIG. 5 is a vertical section taken on line 5 — 5 of FIG. 3, showing the filters and with parts broken away to show the blower drives.

Referring to FIGS. 3 and 5, the hopper H is supported on frame elements 40 by a pivot rod 42 so that the hopper can be elevated to its dumping position (not shown). The hopper has a bottom wall 4 formed with wheel wells 46 (FIG. 3) and the right hand wheel well 46 has bolted thereto a short pipe 48 (FIG. 3) which makes sealing connection by means of a gasket 50 with another short pipe 22b. The pipe 22b is clamped to a large flexible hose 22a, the parts 22a, 22b and 48 forming the air return line 22 from the pickup hood P to the hopper.

The hopper has a rear wall 52 (FIG. 3) with a dump opening closed by a door 56 pivotally mounted on an upper portion of the rear wall at 57. The door is maintained in its closed position by manually operated latches 58 on the pivot rod 42 (FIG. 3). The latches can be controlled by means, not shown, from the driver's compartment through an operating cable 60 and they are spring urged into their latched position.

Figure 4:
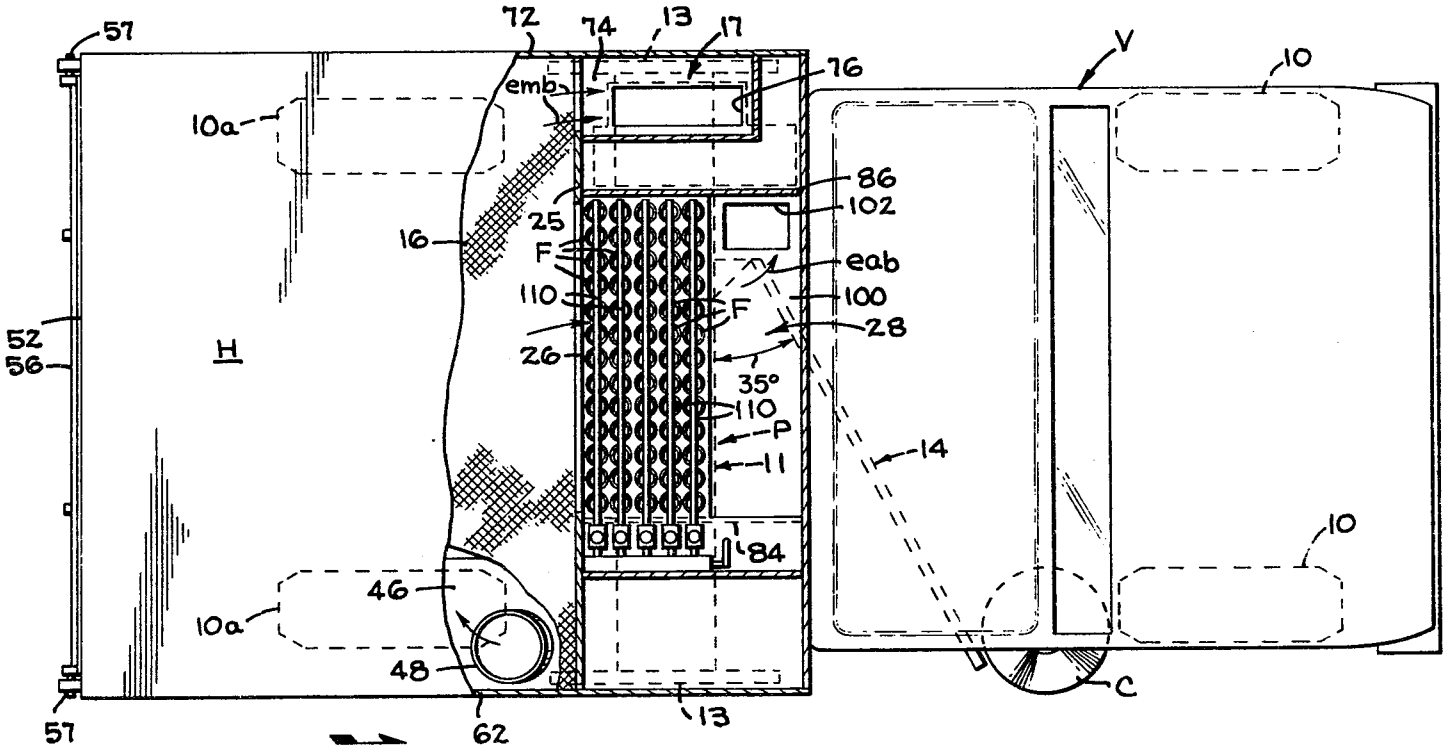
FIG. 4 is a plan of the sweeper of the present invention with parts broken away.

The right side wall 62 of the hopper is on the outer side of the air return pipe 48. As seen in FIGS. 3 and 4, the screen 16 extends from the front partition 25 to the rear wall 52 of the hopper and as seen in FIG. 4 the screen 16 extends laterally between the right side wall 62 and a left side wall 72 of the hopper. The hopper has a roof 66. The main blower is at the left of the filter units F, as seen in FIGS. 2 and 5 and is in front of the partition 25. As seen in FIG. 5, the lower wall 74 of the air return chamber 17 is apertured at 76 and the wall 74 makes a sealing connection by means of a gasket 78 (FIG. 5) with the inlet duct 18 of the main blower.

As to the dust filter portion of the sweeper although the filter system shown represents a preferred construction, the details of the filter construction are not critical to the present invention and other filter systems may be employed. The partitions 27, from which the filters F are suspended projects forwardly from the front partition 25 of the hopper. The filters depend into a fine dust collecting chamber 79 (FIGS. 1 and 2) which is formed by a front vertical wall 80 that joins a rearwardly inclined bottom wall 82 that cooperates with the hopper partition 25 to form a dust collection chamber. The dust chamber is closed by side walls 84,86, best seen in FIGS. 2, 4 and 5. The partition 25, which forms one wall of the dust collecting chamber, is apertured at 88 (FIGS. 1 and 2) for discharging fine dust when the hopper is elevated. The discharge aperture 88 is closed by a door 90 (FIGS. 1 and 3) pivotally mounted at 91 to the hopper partition 25. The door 90 is linked to the main hopper rear door 56 by a link 92 (FIG. 3). With this construction, both doors 56 and 90 can be opened for dumping debris when the hopper is elevated, as shown in Larsen U.S. Pat. No. 4,006,511.

A baffle 96 (FIGS. 3 and 5) and manually controlled door structure operated by a handle 97 (FIG. 3) may be provided to bypass the filters F during wet operation. This structure is shown in detail in FIG. 6 of Larsen U.S. Pat. No. 4,006,511 and the details of the structure are not critical to the present invention and hence are not shown. The lower portion of the filtered air chamber 28 is closed by a flange or floor 100 (FIGS. 2 and 4). The floor 100 is formed with a port 102 (FIG. 4) to be brought into sealing engagement with a gasket 104 (FIG. 1) mounted on the inlet 30 to the auxiliary blower AB. The top of the filtered air chamber is a front portion of the hopper roof 66. Filtered air is drawn through port 102 for entering the auxiliary blower, as indicated by the arrows "*eab*".

In order to minimize variations of pressure drop that occur across the tubular filter elements F, these elements are periodically and automatically cleaned by pulses of high pressure air directed to air jet tubes 110 (FIGS. 4 and 5) which have openings centered above the normal outlet of each filter element. The details and nature of the manner in which the filter elements are periodically cleaned are not critical to the present invention. As suitable system is disclosed in the aforesaid Groh U.S. Pat. No. 4,007,026. Other filter cleaning systems, such as that shown in the U.S. Pat. No. 3,395,349, to Kleissler, issued Aug. 6, 1968, may be employed.

Drives

The blowers, the driving mechanism for the blowers and an engine that drives them all are mounted in a compartment 120 (FIGS. 3 and 5) that remains fixed on the chassis frame when the hopper is tilted. Within the compartment is an internal combustion engine 122 (FIGS. 3 and 5). The rear end of the crankshaft 124 of the engine is connected to a universal joint 126 (FIG. 5) which drives a pulley shaft 128 supported in a bearing plate 129 on the truck platform. The shaft 130 of the auxiliary blower AB is supported in the bearing plate 129 and is driven from a pulley 132 on the shaft 128 (FIGS. 3 and 5), a V-belt 134 and a pulley 136 on the blower shaft 130. The shaft 138 for the main blower MB is also supported in the bearing plate 129 and is driven by the same V-belt 134 and pulley 140 on the end of the blower shaft. As mentioned, in the illustrated embodiment of the invention, the blowers are so sized and are driven at such speeds that the main blower MB circulates about 3,000 c.f.m. of air and the auxiliary AB blower circulates about 1,000 c.f.m. of air.

Hood Construction

Referring principally to FIGS. 6 – 10, the pickup hood P includes the duct 11 which is a generally elongate, rectangular box having an open bottom and extending transversely of the sweeper. The duct is formed with a top wall 150, a left end (upstream) wall 152 (as viewed from the rear and a right end (downstream) wall 154. These end walls mount the skids 13 by means of angle irons **152*a*, 154*a*, secured to their respective end walls. The duct 11 also has rear and front walls 156,158 depending from the top wall 150 and stopping short of the ground. The parts just described are formed of sheet metal and it can be seen that the air inlet duct 20 from the main blower and the air exhaust duct 22 that directs air to the hopper make connections with the top wall 150 and with the respective end walls 152,154**.

Figure 7:
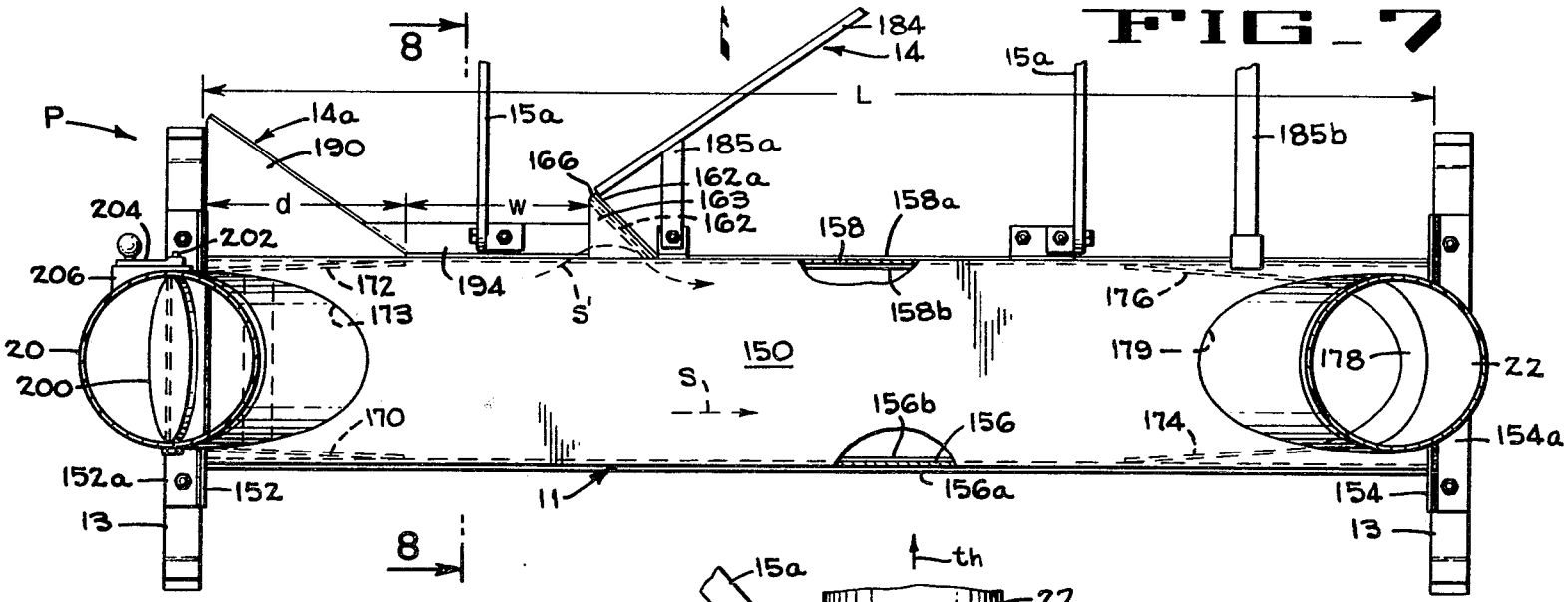
FIG. 7 is a plan view of the hood with portions broken away.
Figure 10:
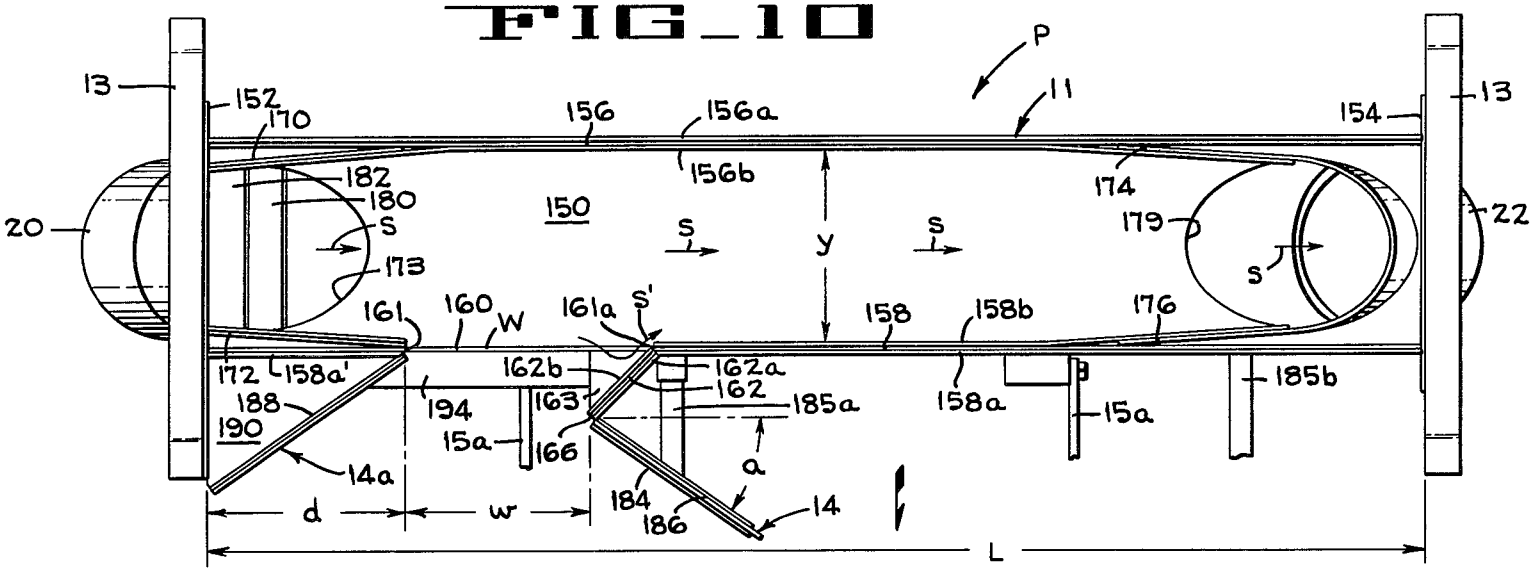
FIG. 10 is a bottom view of the hood with part of the windrowing device broken away.
Figure 11:
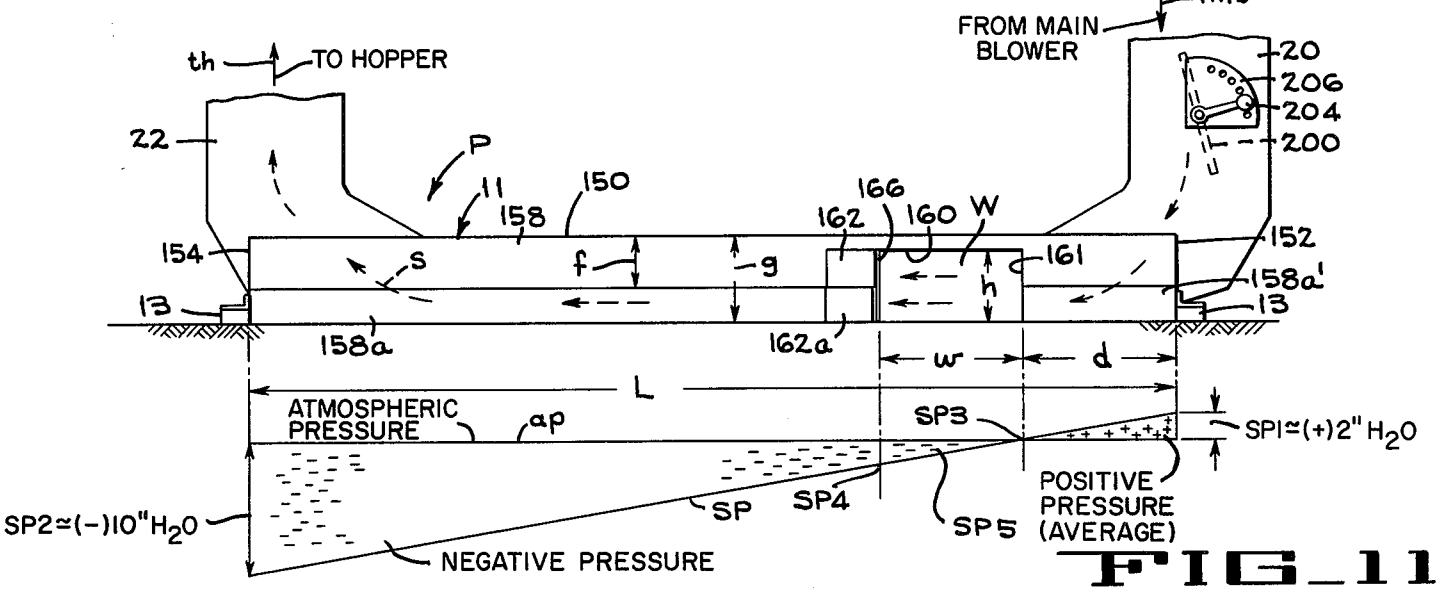
FIG. 11 is a diagrammatic front view of the hood associated with a pressure diagram for explanation of the principles of the invention.

In order to provide the window W for admission of large articles, the front wall 158 is formed with a cutout having a top edge 160, an upstream edge 161 and a downstream edge **161*a*. The downstream edge 161*a* merges with a short angle plate 162 that projects from the edge 161*a* in an upstream direction at an acute angle of about 45° with the front wall 158, which is parallel to the longitudinal axis of the duct 11. The angle plate 162 is covered by a triangular top plate 163 connected to the plate and to the front side wall 158. Thus, as seen in FIGS. 7, 10 and 11, the portion of the window W that is formed in the sheet metal portion of the hood is defined by the top edge 160**, and its width *w* is defined by the upstream edge 161 of the front side plate and by the free end 166 of the angle plate 162. The lower portions of the window edges are defined by flaps, to be described in detail presently.

In order to provide a smooth transition between the air inlet conduit 20 and the duct 11 and the air outlet conduit 22 and the duct, fairing plates are provided at both ends of the duct. Referring to FIG. 10, which is a bottom view of the duct, upstream fairing plates 170,172 are connected to the top plate 150, the end plate 152 and the front and rear side plates 156,158 downstream of the end plate 152. These plates straddle the air inlet port 173 and minimize the development of turbulence or stagnation zones as the air enters the duct.

Figure 9:
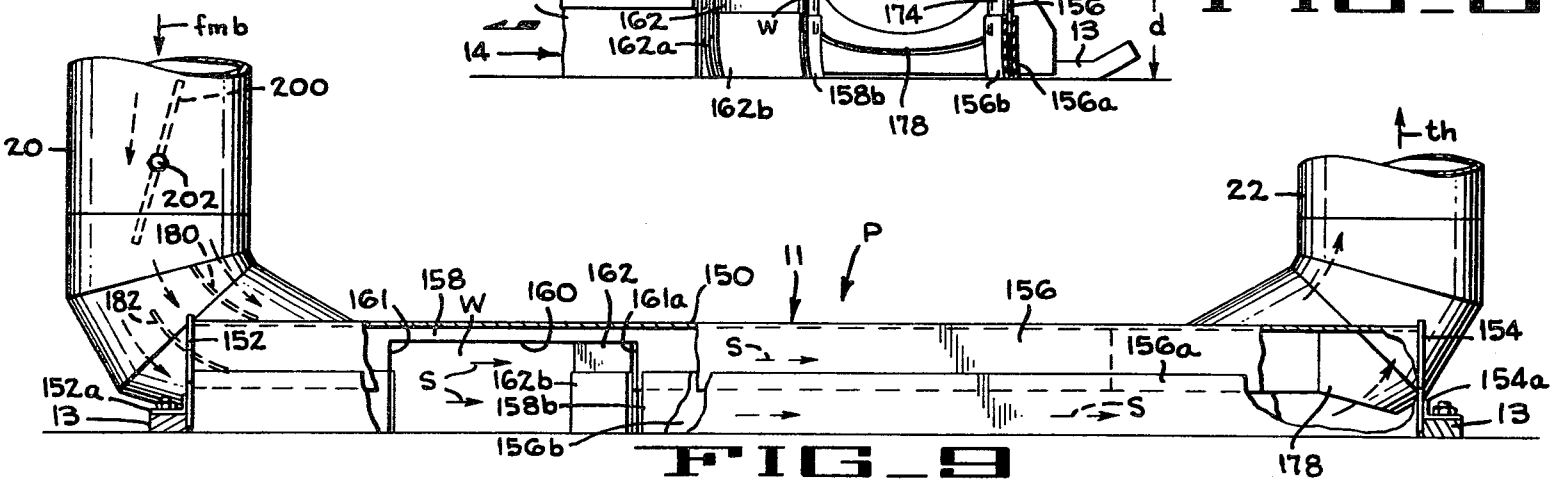
FIG. 9 is a rear view of the hood with rear parts broken away to show the window at the front.

As seen in FIGS. 9 and 10, downstream fairing plates 174,176 connect to the top 150. The rear and front side walls 156,158 and their downstream ends connect to a projection 178 of the outlet conduit 22. Thus, the stream of air circulating along the duct is smoothly directed into the outlet port 79 for the outlet conduit 22 leading to the hopper. In order to reduce turbulence as the incoming stream of air changes direction from the inlet conduit 20 to the duct 11, curved baffle plates 180,182 (FIGS. 9 and 10) are provided at the elbow of the inlet duct 20. These baffles assist in changinging the direction of the incoming stream of air without turbulence so that the air stream "*s*" will begin to flow smoothly along the interior of the duct 11.

Flaps

As mentioned, the rear and front side walls 156,158 stop short of the ground. A system of flaps forms a continuation of these side walls and make flexing and sealing engagement with the ground or swept surface in a known manner. These flaps are formed of flexible material such as rubber, in the conventional manner and are secured to their associated sheet metal elements by bolts or cap screws (not shown) in a known manner.

The rear wall 156 of the duct is provided with an outside flap **156*a* and an inside flap 156*b* (FIG. 10). The outside flap 156*a* extends between the end walls 152,154. The inside flap 156*b* extends along the fairing plate 170, the intermediate section of the rear wall 156 and the other fairing plate 174**.

Figure 6:
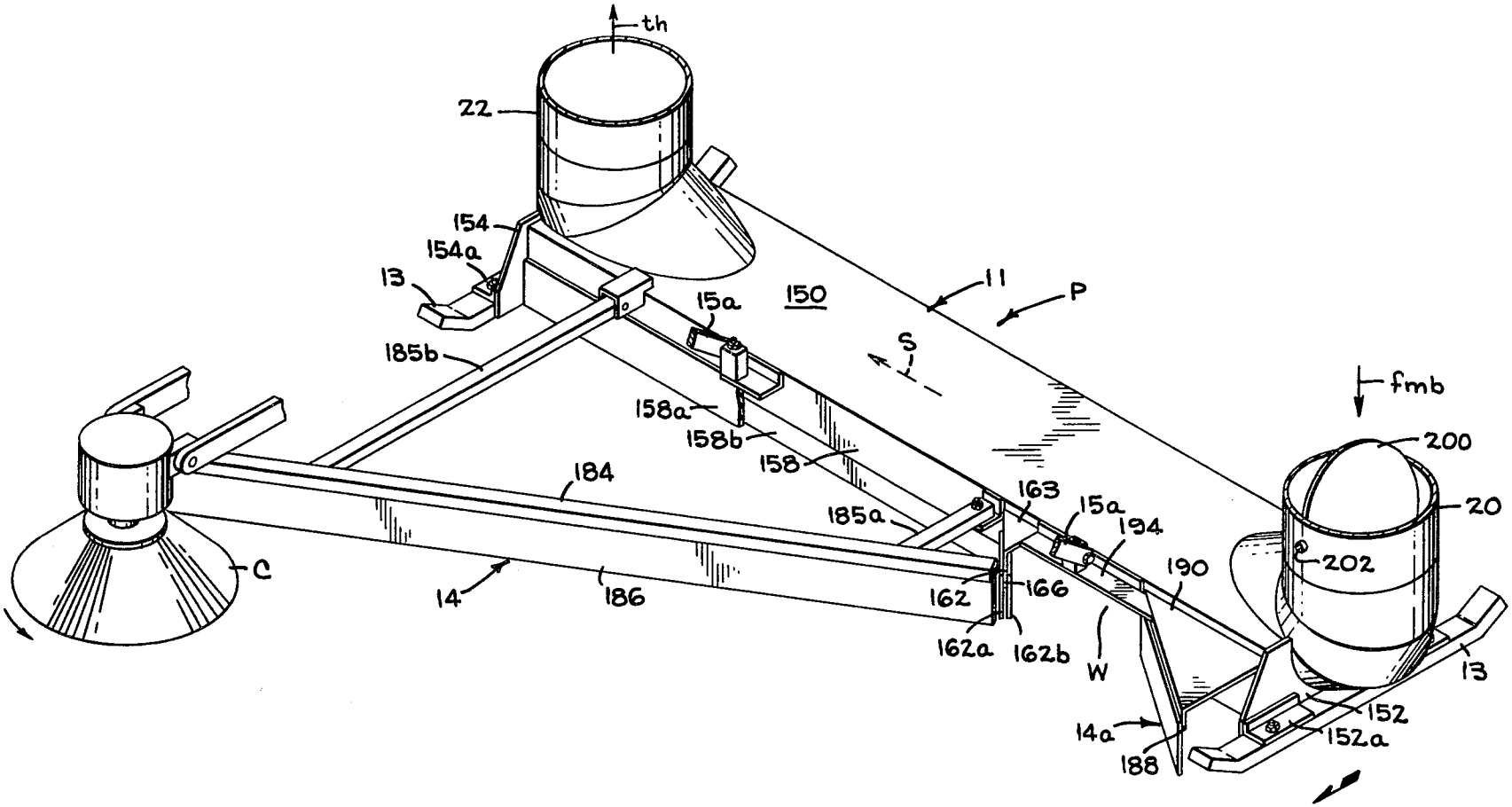
FIG. 6 is a schematic perspective diagram of a hood embodying the present invention.
Figure 8:
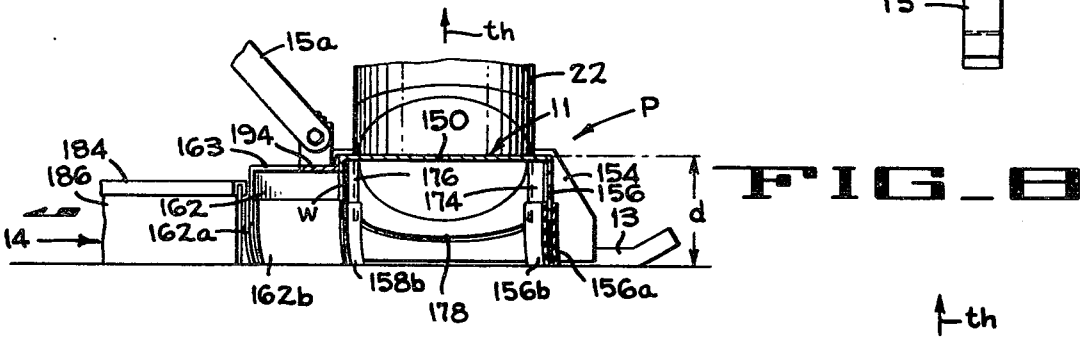
FIG. 8 is a section of the hood taken on line 8 — 8 of FIG. 7.

The front flaps are interrupted by the window W. The front plate 158 has a long outside flap **158*a* which extends along the wall 158 between the cutout edge 161*a* and the downstream end plate 154. There is also a short outside flap 158*a*' which extends along the wall 158 between the cutout edge 161 and the upstream end plate 152. Thus, except for the portion of the duct at the window W, the duct side walls are provided with a double flexible flap system. The angle plate 162 is provided with oppoaed flaps 162*a*, 162*b* as seen in FIGS. 6, 8 and 10**.

Windrowers

As previously described the windrowers or deflectors include a long deflector 14 and a short deflector **14*a*. The long deflector 14 diverges from the end 166 of the angle plate 162 which end forms one vertical wall of the window W. The long deflector 14** diverges at an angle "*a*" of about 30° (FIG. 10) from a line parallel to the longitudinal axis of the duct 11. The deflector is formed with a stiff channel 184 along its upper edge (FIG. 8) which mounts a semi rigid but flexible scraper or windrowing blade 186 preferably formed of polyethylene. This material has the advantage of having a low coefficient of friction so that the blade 186 slides freely along the articles as the sweeper advances. As mentioned, the inner end of the deflector 14 forms a continuation of the outer edge 166 of the angle plate 162 and as indicated in FIGS. 1 and 2, the free outer end of the deflector 14 terminates at a zone representing the prolongation of the right end plate 154 of the hood.

Were it not for the short angle plate 162, the deflector 14 would project directly from the downstream edge 161*a* of the window W. Under these conditions, air flowing along the front wall 158 of the hood could impinge upon the end edges of the window and deflector, whereupon the deflector 14 would divert air out of the hood. The angle plate 162 prevents this action by redirecting air that might be thus diverted back into the duct 11, as indicated by the arrows "*s*'" in FIGS. 7 and 10.

The short windrower or deflector 14*a* is formed by a depending metal flange 188 (FIGS. 6 and 10) diverging from the upstream edge 161 of the window W at about the same angle at which the long windrower 14 diverges. The depending plate 188 terminates in a zone that forms the prolongation of the end wall 152. The depending flange 188 is connected to the hood by a triangular plate 190. One leg of plate 190 connects to the front wall 158, the other leg to end plate 152 and the hypotenuse connects to the deflection flange 188. The angled flange 188 mounts a semi-rigid but flexible deflector, or windblower blade formed to the same material as the blade 186 for the long deflector 14. The two deflectors 14,14*a* deflect and guide large objects into the window W as the sweeper advances, so that these objects do not lift the flaps defining the hood duct with the attendant intake or puffing out of air. Small particles of dirt or dust may be admitted to the duct from beneath the front flaps of the duct without causing any significant intake or puffing out of air from the duct.

A horizontal plate 194 (FIGS. 6, 7 and 10) extends along the upper edge 160 of the window W between the triangular plates 163 and 190. As seen in FIGS. 6 – 8, the plate 194 mounts of the two pivoted trailing arms 15*a* for dragging the hood along the surface.

The deflector channel 184 is connected to the front wall of the hood by short and long brackets 185*a*,185*b*.

Damper

As seen in the diagram of FIG. 1 and as shown in FIG. 2, in the preferred sweeper embodying the invention, both main and auxiliary blowers are provided. The main blower MB, is the principal source of energy for the circulating air stream "*s*" flowing along the interior of the duct 11. This blower draws air through the relatively coarse screen 16 which merely filters out coarse particles and does not become obstructed. Once the blower size and speed and duct sizes are selected, operation of the main blower is consistent during a sweeping operation.

The auxiliary blower, AB, also contributes to the circulating stream of air "*s*" in the duct and draws in an amount of air that is equivalent to an amount of air that may enter the duct 11 from the curb brush system (if provided), through the window W and from beneath the flaps surrounding the duct. However, the front flaps, in accordance with the present invention, are not raised to admit large articles, thereby removing air entry zones that may be present in conventional air recirculation hoods, and even more important, eliminating the puffing out of dust at zones where large articles lift the flaps as the hood traverses them. The auxiliary blower draws air through the filters F but these filters are periodically and frequently cleaned, as previously described and hence the effect of the presence of the auxiliary blower AB is also substantially constant during the sweeping operation. As will be described in detail in connection with FIG. 11, one of the elements of the present invention is in selecting blower, size, speed and air flow rates such that the static air pressure of the flowing stream of air "*s*" within the duct 11 is at atmospheric pressure at the upstream edge 161 of the window W. In the preferred embodiment of the invention, this mode of operation is designed into the machine, but it is envisualized that under some circumstances, it may be desirable to provide means for "fine tuning" the location of the zone of zero or atmospheric static pressure in the air stream relative to the upstream window edge 161. Thus, it is contemplated that a damper 200 may be provided in the system, such as in the air inlet duct 22 from the main blower MB. The damper 200 may be of the conventional circular or disc type damper construction and is rotatably mounted, in the embodiment shown, on a shaft 202. Any means for adjusting and maintaining adjustment of the damper 200 may be provided in accordance with known devices of this sort. In the embodiment shown, the adjustment is provided by a manually operable handle 204, keyed to the shaft 202 and having a detent construction that cooperates with apertures or detents in a fixed quadrant 206 as best seen in FIG. 11. The addition of the damper is a refinement to the system and in the preferred embodiment of the invention the flows induced by the two blowers (or by a single main blower if such is the construction) are balanced and maintained in balance so that a damper for the purposes described is usually not required.

Principles of Operation

The principles of operation of the hood of the present invention will be described in connection with the schematic diagram of the hood in FIG. 11 and the associated pressure diagram. In FIG. 11 the deflectors 14 and 14*a* have been omitted for clarity. As seen in the upper portion of FIG. 11, the window W has a width "*w*" and a height "*h*" from the cleaned surface along which the pickup hood P is propelled. The upstream edge 161 of the window is positioned at a distance "*d*" from the upstream end wall 152 of the duct 11. The total length of the duct is indicated by the arrow "L" and the height of the duct above the swept surface is indicated at "*g*". As previously explained the blower system, either comprising a single main blower, or, as in the preferred embodiment, main and auxiliary blowers is so constructed and driven and the ducting system is so designed that the upstream edge 161 of the window W is disposed at a zone where the static pressure of the stream of air "*s*" being circulated through the duct 11 is at zero gauge or atmospheric pressure. In designing a system including the hood embodying the present invention, the desired blower system was connected to the hood and the pressure of the air stream "*s*" flowing along the hood was measured at various points along the length of the hood by the installation of a longitudinal row of Pitot tubes into a wall of the hood, which measured the static pressure of the air stream at a series of positions along the hood.

In the pressure diagram forming the lower part of FIG. 11, a horizontal atmospheric pressure line "*ap*" is shown as well as an included static pressure line SP, indicating the static pressure of the air stream "*s*" at all points along the duct 11 from the inlet end wall 152 to the downstream end wall 154. As indicated in the pressure diagram, at the upstream wall 152, in the embodiment being tested, the static pressure SP1 was a positive pressure about equal to plus 2 inches of water, gauge (0.0728 psig). In the system being tested the static pressure SP2 at the downstream end wall 154 of the duct was negative and was about minus 10 inches of water gauge (0.361 psig).

As indicated by the static pressure line SP in the pressure diagram of FIG. 11, the static pressure progressively decreased from the positive pressure at the wall 152 to a negative pressure at the downstream wall 154. The static pressure line SP crosses the atmospheric pressure line "*a*" at point SP3 and at this point, the static pressure of the circulated air stream "*s*" is zero gauge, that is, the static pressure of the airstream at the point SP3 is equal to atmospheric pressure. In designing the duct 11, the upstream edge 161 of the window W was placed so as to coincide with the atmospheric pressure point SP3.

The window has a width "*w*" that is adequate to admit most of the larger objects encountered by the sweepers such as cans, bottles, etc. The downstream edge 166 of the window is positioned at a zone wherein the static pressure SP4 is slightly negative but is substantially greater than the negative pressure SP2 at the outlet end of the hood. In the present example, the static pressure of the airstream at the zone SP4 would be about 1.8 inches of water (0.065 psig). since the pressure conditions across the width "*w*" of the window start with zero at zone SP3 (upstream edge 161) and drops to minus 1.8 inches of water at zone SP4 (downstream edge 166) the average negative static pressure of the air stream along the width "*w*" of the window will be about 0.9 inches of water (0.032 psig). Thus even though the window W is completely unobstructed, the amount of air drawn into the hood through the window is relatively small and is easily compensated for in the preferred embodiment of the invention, by providing an auxiliary blower which supplements the main blower and withdraws quantity of air from the hopper that at least equals the quantity of air admitted through the unobstructed window.

Specific Example

To give a typical specific example of a preferred embodiment of the invention, the main blower MB is constructed and operated to deliver about 3,000 cubic ft./min. of air through a circular section inlet duct 20 of about 10 inches in diameter. The auxiliary blower AB withdraws about 1,000 cubic ft./min. of air from the filter chamber. The length L of the duct 11 is 68 inches and the height "*g*" of the duct is 6¼ inches. The depth "*f*" of the front and rear walls 158,156 is 3.75 inches. The width "*y*" of the duct (FIG. 10) is 13 inches. The width "*w*" of the window is 10½ inches and its height "*h*" is 5½ inches. The upstream edge 161 of the window is formed a distance "*d*" from the upstream end wall 152 of about 11 inches. Of course, the dimension "*d*" of FIG. 11 will depend upon the air flow conditions through the hood and, as mentioned, these conditions are experimentally determined during design of the hood and blower system so that the upstream edge 161 of the window will be at a zero static pressure position in accordance with the present invention.

In addition to or preferably in place of damper 200 of FIG. 11, an adjustably positioned auxiliary damper 210 (FIG. 5) is fitted in the exhaust duct 32 of the auxiliary blower AB. This damper can be adjusted to maintain the position of the atmospheric static pressure point SP3 of FIG. 11 in coincidence with the upstream edge 161 of the unobstructed window W.

Although the best mode contemplated for carrying out the present invention has been herein shown and described, it will be apparent that modification and variation may be made without departing from what is regarded to be the subject matter of the invention as defined in the appended claims.

I claim:

1. In a mobile street sweeper or the like of the type comprising a vehicle carrying a hopper, an elongate, transversely disposed debris pickup hood of the air recirculation type having front and rear walls, blower means for withdrawing air from the hopper and introducing the air under pressure through an air delivery line to an upstream end of the hood, means for driving said blower means, an air return line for returning air from the downstream end of the hood to the hopper thereby causing a stream of air to flow along the hood, a bulky object admitting window formed in the front wall of the hood, said window being substantially shorter than the hood and having upstream and downstream ends and means for windrowing objects into said window; the improvement wherein said blower means, blower drive means, air delivery line, hood and air return line produce an air flow rate that provides a first zone intermediate the length of said hood wherein the static pressure of said air stream substantially equals atmospheric pressure, the static pressure of said air stream downstream of said first zone becoming progressively more negative relative to atmospheric pressure, the upstream edge of said window being disposed substantially at said first or atmospheric pressure zone of said hood, the downstream edge of said window being disposed at a second zone along said hood wherein the static pressure of said air stream is slightly less than atmospheric pressure but is substantially greater than the negative static pressure of said air stream at said air return line, said window being unobstructed during normal operation of the sweeper for freely admitting bulky objects along with a small stream of air.

2. The sweeper of claim 1, wherein the front wall of said hood has a first portion extending from the upstream end of the hood to said upstream window end and a second portion extending from a zone downstream of said downstream window end to the downstream edge of the hood, angle plate means projecting upstream from the upstream end of said second wall portion and diverging from a line parallel to the longitudinal axis of the hood, said angle plate means having a free end, said windrowing means comprising article deflection means projecting from the free end of said angle plate means toward the upstream end of the hood and diverging from a line parallel to the longitudinal axis of the hood, the junction of said angle plate and article deflection means forming the downstream end of said window, said angle plate means redirecting air that impinges on said junction back into the hood.

3. The sweeper of claim 2, comprising a cover plate for said angle plate means that connects to said hood.

4. In a mobile street sweeper or the like of the type comprising a vehicle carrying a hopper, sweeper means comprising an elongate, transversely disposed debris pickup hood of the air recirculation type comprising a closed end duct with front and rear walls having flexible surface engaging flaps, blower means including a main blower for withdrawing air from the hopper and introducing the air under pressure through an air delivery line to a zone adjacent an upstream end of the hood, means for driving said blower means, an air return line adjacent the other end of the hood for returning air from the downstream end of the hood to the hopper thereby causing a stream of air to flow along the hood, a bulky object admitting window formed in the front of said duct, said window being substantially shorter than the duct and having upstream and downstream ends and means for windrowing objects into said window; the improvement wherein said blower means, blower drive means, air delivery line, hood and air return line produce an air flow rate that provides a first zone intermediate the length of said duct wherein the static pressure of said air stream substantially equals atmospheric pressure, the static pressure of said air stream downstream of said first zone becoming progressively more negative relative to atmospheric pressure, the upstream edge of said window being disposed substantially at said first or atmospheric pressure zone of said duct, the downstream edge of said window being disposed at a second zone along said duct wherein the static pressure of said air stream is slightly less than atmospheric pressure but is substantially greater than the negative static pressure of said air stream at said air return line, said window being unobstructed during normal operation of the sweeper for freely admitting bulky objects along with a small stream of air.

5. The sweeper of claim 4, wherein the front wall of said duct has a first portion extending from the upstream end of the hood to said upstream window edge and a second portion extending from a zone downstream of said downstream window edge to the downstream end of the duct, angle plate means projecting upstream from the upstream end of said second wall portion and diverging from a line parallel to the longitudinal axis of the duct, said angle plate means having a free end, said windrowing means comprising article deflection means projecting from the free end of said angle plate means toward the upstream end of the duct and diverging from a line parallel to the longitudinal axis of the duct, the junction of said angle plate and article deflection means forming the downstream end of said window, said angle plate means redirecting air that impinges on said junction back into the duct.

6. The sweeper of claim 5, comprising a cover plate for said angle plate means that connects to said duct.

7. The sweeper of claim 6, comprising flexible surface engaging flap means depending from said angle plate means.

8. The sweeper of claim 4, wherein air inlet and outlet conduits are connected, respectively, to said air delivery and said air return lines and to opposite ends of said duct, said conduits having duct ports of smaller diameter than the width of the duct, fairing plates extending between said duct ports and their associated front and rear duct walls, and surface engaging flaps on said fairing plates.

9. In a mobile street sweeper or the like of the type comprising a vehicle carrying a hopper, a dust filter chamber opening to said hopper and containing filters, means for periodically cleaning the filters, sweeper means comprising an elongate, transversely disposed debris pickup hood of the air recirculation type comprising a closed end duct with front and rear walls having flexible surface engaging flaps, blower means including a main blower for withdrawing air from the hopper and introducing the air under pressure through an air delivery line to a zone adjacent the upstream end of the hood, an auxiliary blower for withdrawing filtered air from said filter chamber and exhausting it to the atmosphere, means for driving said blowers, an air return line adjacent the other end of the hood for returning air from the downstream end of the hood to the hopper thereby causing a stream of air to flow along the hood, a bulky object admitting window formed in the front wall of said duct, said window being substantially shorter than the duct and having upstream and downstream ends and means for windrowing objects into said window; the improvement wherein said blower means, blower drive means, air delivery line, hood and air return line produce an air flow rate that provides a first zone intermediate the length of said duct wherein the static pressure of said air stream substantially equals atmospheric pressure, the static pressure of said air stream downstream of said first zone becoming progressively more negative relative to atmospheric pressure, the upstream edge of said window being disposed substantially at said first or atmospheric pressure zone of said duct, the downstream edge of said window being disposed at a second zone along said duct wherein the static pressure of said air stream is slightly less than atmospheric pressure but is substantially greater than the negative static pressure of said air stream at said air return line, said window being unobstructed during normal operation of the sweeper for freely admitting bulky objects along with a small stream of air.

10. The sweeper of claim 9, wherein the front wall of said duct has a first portion extending from the upstream end of the hood to said upstream window edge and a second portion extending from a zone downstream of said downstream window edge to the downstream end of the duct, angle plate means projecting upstream from the upstream end of said second wall portion and diverging from a line parallel to the longitudinal axis of the duct, said angle plate means having a free end, said windrowing means comprising article deflection means projecting from the free end of said angle plate means toward the upstream end of the duct and diverging from a line parallel to the longitudinal axis of the duct, the junction of said angle plate and article deflection means forming the downstream end of said window, said angle plate means redirecting air that impinges onsaid junction back into the duct hood.

11. The sweeper of claim 10, comprising a cover plate for said angle plate means that connects to said duct.

12. The sweeper of claim 11, comprising flexible surface engaging flap means depending from said angle plate means.

13. The sweeper of claim 9, wherein air inlet and outlet conduits are connected, respectively, to said air delivery and said air return line and to opposite ends of said duct, said conduits having duct ports of smaller diameter than the width of the duct, fairing plates extending between said duct ports and their associated front and rear duct walls, and surface engaging flaps on said fairing plates.

14. The sweeper of claim 9, comprising damper means disposed in one of said lines for controlling the air flow therein and precisely determining the position of said atmospheric pressure zone along said duct relative to the upstream edge of said window.

15. The sweeper of claim 14, wherein said damper means is disposed in said air delivery line.

* * * * *

UNITED STATES PATENT AND TRADEMARK OFFICE

CERTIFICATE OF CORRECTION

PATENT NO. : 4,099,290

DATED : July 11, 1978

INVENTOR(S) : J. A. Hiszpanski

It is certified that error appears in the above—identified patent and that said Letters Patent is hereby corrected as shown below:

Column 3, line 14, "chmber" should read -- chamber --.

Column 4, line 44, "and" should read -- the --.

Column 5, line 47, "chasis" should read -- chassis --.

Column 7, line 67, "4" should read -- 44 --.

Column 8, line 31, "partitions" should read -- partition --.

Column 8, line 65, after "tubular" should read -- porous --.

Column 9, line 4, "As" should read -- A --.

Column 11, line 34, after "mounts" -- one -- should be inserted.

Column 11, line 43, "principal" should read -- principle --.

Signed and Sealed this

*Ninth* Day of *September 1980*

[SEAL]

*Attest:*

SIDNEY A. DIAMOND

*Attesting Officer*

*Commissioner of Patents and Trademarks*